United States Patent [19]

Gilles

[11] Patent Number: 4,699,202

[45] Date of Patent: Oct. 13, 1987

[54] SYSTEM AND METHOD FOR CONTROLLING SECONDARY SPRAY COOLING IN CONTINUOUS CASTING

[75] Inventor: Herbert L. Gilles, Macungie, Pa.

[73] Assignee: Bethlehem Steel Corporation, Bethlehem, Pa.

[21] Appl. No.: 914,841

[22] Filed: Oct. 2, 1986

[51] Int. Cl.[4] ..... B22D 11/22

[52] U.S. Cl. ..... 164/455; 164/414

[58] Field of Search ..... 164/455, 414, 444, 486

[56] References Cited

U.S. PATENT DOCUMENTS 4,562,880 1/1986 Larrecq et al. ..... 164/455

*Primary Examiner*—Kuang Y. Lin

*Attorney, Agent, or Firm*—John I. Iverson

[57] ABSTRACT

A system and method is provided for cooling a continuous casting, which includes determining, for each element of steel, the steel residence time in each cooling spray zone of the secondary cooling and determining residence time flow rates as a function of average speed, grade, mold heat removal and section size of the steel strand. The system modifies the residence time flow signal using a feedback error flow signal that is derived in a feedback flow control loop. The feedback error flow signal is derived by comparing the actual measured specific flow GAL/FT$^2$, based on the actual measured quantity of specific cooling water that each element of steel has received, with a calculated reference specific flow. The specific flow signal is further used to determine whether the system is to use the modified residence time flow or whether the flow should be shut off when the measured specific flow exceeds a maximum reference specific flow.

11 Claims, 16 Drawing Figures

RESIDENCE TIME CALCULALOR
56
RESIDENCE TIME AVERAGE SPEED CALCULATOR
58
RESIDENCE TIME FLOW RATE CALCULATOR
54
62
FEEDFORWARD RESIDENCE TIME FLOW
44
SUMMING DEVICE
51A
64
FEEDBACK FLOW CORRECTION
52
OUTPUT FLOW DEVICE
29
FLOW INPUT CONTROL
70
55
MAXFLOW COMPARATOR
66
COMPARATOR
ACTUAL SPECIFIC FLOW MEASUREMENT DEVICE
68
REFERENCE SPECIFIC FLOW CALCULATOR
63
SPECIFIC FLOW GENERATOR
61
60

SYSTEM AND METHOD FOR CONTROLLING SECONDARY SPRAY COOLING IN CONTINUOUS CASTING

FIELD OF THE INVENTION

The present invention relates to continuous casting machines, and more particularly to the automatic control of secondary cooling in continuous casting machines.

BACKGROUND ART

Continuous casting machines are used in the basic metal industry to continuously produce semifinished billets, slabs, and the like from molten metal in a one-step solidification process. Generally, molten metal from a tundish is continuously introduced into a water-cooled mold where initial solidification takes place in the form of a frozen metal skin surrounding a liquid core as the cast product continuously leaves the mold. The molten metal continues to solidify progressively inwardly in a secondary cooling zone where complete solidification of the cast product occurs in the spray cooling, roll cooling and radiation cooling zones located beyond the caster mold.

In order to have successful caster operation, a precise amount of solidification or skin growth must continuously occur. If too much heat is removed, surface cracks and internal defects may develop in the strand. If too little heat is removed, a breakout of molten metal will occur in the caster which may result in serious consequences to both personnel and facilities.

Therefore, it is important to continuously control the caster heat removal rate for preventing problems which can occur in the continuous casting operation. Early casters had only simple control of spray cooling water rates. The flow in each zone was usually set before each cast and remained constant. As more grades with greater temperature senstivity were cast a better means of cooling control was needed. A first known method for controlling the cooling of the cast product in a continuous casting involves controlling the flow in each zone as a direct function of casting speed. In this method, the cooling water rates are correct only when steel passing through a spray zone has traveled at a steady speed from the time it started at the meniscus. When speed changes occur, the strand will experience temperature perturbations until fresh steel at a new steady state fills the spray chamber. These temperature disturbances can cause surface and internal defects.

To overcome this deficiency, a second known method has been the control of flow as a function of the steel residence time in each zone. With residence time control, theoretically each element of steel entering the machine is cooled in the same way since time is the controlling factor. As speed changes, the entire cooling profile along the machine changes. For example, if the maximum speed is reduced by 50% then the new steel entering the machine is cooled in 50% of the spray distance. This known method of controlling the coolant water flow as a function of the steel residence or elapse time in each zone is described, for example, in British Patent Specification No. 1,302,040 published on Jan. 4, 1973 and in U.S. Pat. No. 4,463,795 to Chielens, et al. In the Chielens, et al. patent, there is described a predictive method of controlling cooling by making residence time calculations and water flow calculations using heat transfer curves. Although the residence time technique is an improvement over previous control methods, important deficiencies still exist. The residence time is a purely predictive control based on calculations, while correct cooling requires that flows follow the computing setpoints. This is not possible in many instances due to mechanical and operational caused problems including the process hardware limitations described below.

Also, there have been proposed the use of temperature controls for overcoming some of the below described deficiencies. In the U.S. Pat. No. 4,073,332 issued on Feb. 14, 1978 to A. T. Etienne, the temperature is measured along the surface of the strand in a series of secondary cooling zones, and the specific coolant flow rate to the zones is varied to maintain a desired thermal profile along the surface of the strand in relation with the casting speed and residence time in each cooling zone. One problem with this system is that the temperature measuring devices cannot be maintained and do not have sufficient capability to give reliable measurements because of the high temperatures and the water and steam environment.

Spray nozzles have a limited operating range and cannot be operated satisfactorily when the flow rate is less than 20 to 33% of the nozzle maximum. Cooling patterns deteriorate and strand cooling becomes irregular when low flow rates are required. Also, most casters have small diameter rolls in the upper part of the machine near the mold which are not internally cooled and require that spray water always be flowing to cool the support rolls and prevent thermal damage. Thus, the strand may be cooled by water when none is required, by a flow rate determined by the roll cooling requirement rather than the strand cooling requirement. Here, again, the predictive control would be bypassed. Finaly, since the spray chamber is divided into a finite number of zones, the residence time control can only supply correct cooling to a small part of a zone. These restrictions cause improper cooling of the strand during transient and abnormal operating conditions. In the situation of long stops or slowdowns for grade, width or tundish changes, which allow for increased productively, severe overcooling of the strand usually results with an attendant decrease in quality.

SUMMARY OF THE INVENTION

In view of the above, it is an object of the present invention to improve the secondary cooling oepration in continuous casting of metals by providing a flow control action which supplements the residence time computed flow. It is another object of the present invention to provide a supplemental control action in the continuous casting of metals which eliminates or minimizes the possibility of overcooling and undercooling by such corrective action for situations that the feedforward residence time technique cannot anticipate. It is another object of the present invention to improve the secondary cooling control in continuous casting to correct for both transient effects due to start-up of a cold machine and variations in the actual effective secondary cooling occurring along the strand. It is another object of the present invention to increase the effective nozzle range to below the practical minimum flows. It is a further object of the present invention to provide a method for utilizing an existing secondary cooling practice from a nonresidence time, speed-flow control technique in conjunction with a residence time calculation technique. It is a further object of the present invention to correct for the disadvantages of employing a predictive coolant control in a continuous casting by incorporating both calculated and measured coolant criteria on a continuous basis for correcting the coolant control.

These and other objects are achieved by the present invention which provides a method of cooling a continuous casting, comprising determining for each element of steel the steel residence time in each cooling spray zone of the secondary cooling zone and using the residence time for each zone to determine the required cooling for that zone, controlling the coolant water flow as a function of such steel residence time in each zone, giving a residence time computed quantity of cooling water that an element of steel should receive in each zone, if it were traveling at such average casting speed, determining residence time zone flow rates as a function of average speed, grade, mold heat removal and section size of the strand, measuring the total quantity of specific flow (gal/ft$^2$) that each element of steel has actually received from the sprays and computing such amount, calculating the specific flow (gal/ft$^2$) in a zone that would be for the average speed, grade, section size, and mold heat removal, and comparing the computed reference specific flow in each zone and the measured specific flow of cooling water (gal/ft$^2$) actually received in that zone to provide a coolant flow correction used as a feedback signal for modifying the residence time zone flow rates. Such modified residence time flow rate is used as the control flow in conjunction with the measured specific flow, computed reference specific flow, and the computed maximum specific flow, to determine if the flow is to be used, or to shut off the flow or to cycle it on and off. The use of the measured value of actual coolant flow to the elements in each zone thereby provides a feedback control for the coolant water control action and thereby supplements the residence time computed flow.

The secondary cooling spray chamber is divided into a number of zones which contain a set of spray water nozzles. Cooling is carried out on a zone-by-zone basis. For all elements of the strand, a specific flow is maintained from the first element exiting the meniscus to the last element leaving the cooling chamber.

The specific flow is the integrated water than an element has accumulated from the time the element first entered the spray chamber to the present time. All the elements of specific water flow taken together are known also as the water history which represents the accumulated water on strand elements from the beginning of the spray chamber to the end of the spray chamber. The specific water history shows the actual gallons per square foot of water applied to the differential elements of the strand and is used in calculating the required amount of gallonage cooling for each zone. This specific water for the element is averaged, and, in addition, a setpoint is produced for that zone.

The feedback flow control loop employs the actual measured specific flow in gallons per square foot and compares it with the reference specific flow to determine the error flow signal used for correcting or modifying the residence time flow rates as described above. The actual measured specific flow is also used to determine whether the system is to use such modified residence time flow or to shut off the flow. This is done by calculating, from the reference specific flow, the maximum specific flow that the system will not be permitted to exceed. This maximum reference specific flow is compared with the measured specific flow and, if the measured specific flow exceeds the maximum reference specific flow, the system flow will be shut off. This is the MAXFLO subroutine which uses the actual measured specific flow feedback for correcting the coolant flow and maintaining the setpoint.

In this fashion, the present invention improves the present residence time approach to continuous casting secondary cooling methods by adding a feedback route which monitors the actual amount of coolant provided to the strand in each spray zone. The measured value of cooling water for each zone is used to determine the additional flow control action to supplement the residence time computed flow. This supplemental control action may trim the residence time flows to remove small disturbances for such action or shut off a zone entirely when the strand has received the total quantity of cooling required. The additional feedback in this manner eliminates the possibility of overcooling and applies corrective action for situations that the feedforward residence time cannot anticipate; such as when a cooling failure occurs in one zone, the following zones will apply a corrective action. Furthermore, the system enhances the control of secondary cooling by modifying the cooling practice to take into account additional process characteristics not previously accounted for. Control of secondary cooling is also enhanced by the present invention by increasing the effective nozzle range to below the practical minimum flows by cycling the minimum flow on-off. Finally, the subject invention provides a method for utilizing the existing critical secondary cooling practice from a nonresidence time control scheme in conjunction with a residence time calculation technique.

DESCRIPTION OF THE PREFERRED EMBODIMENTS

Figure 1:
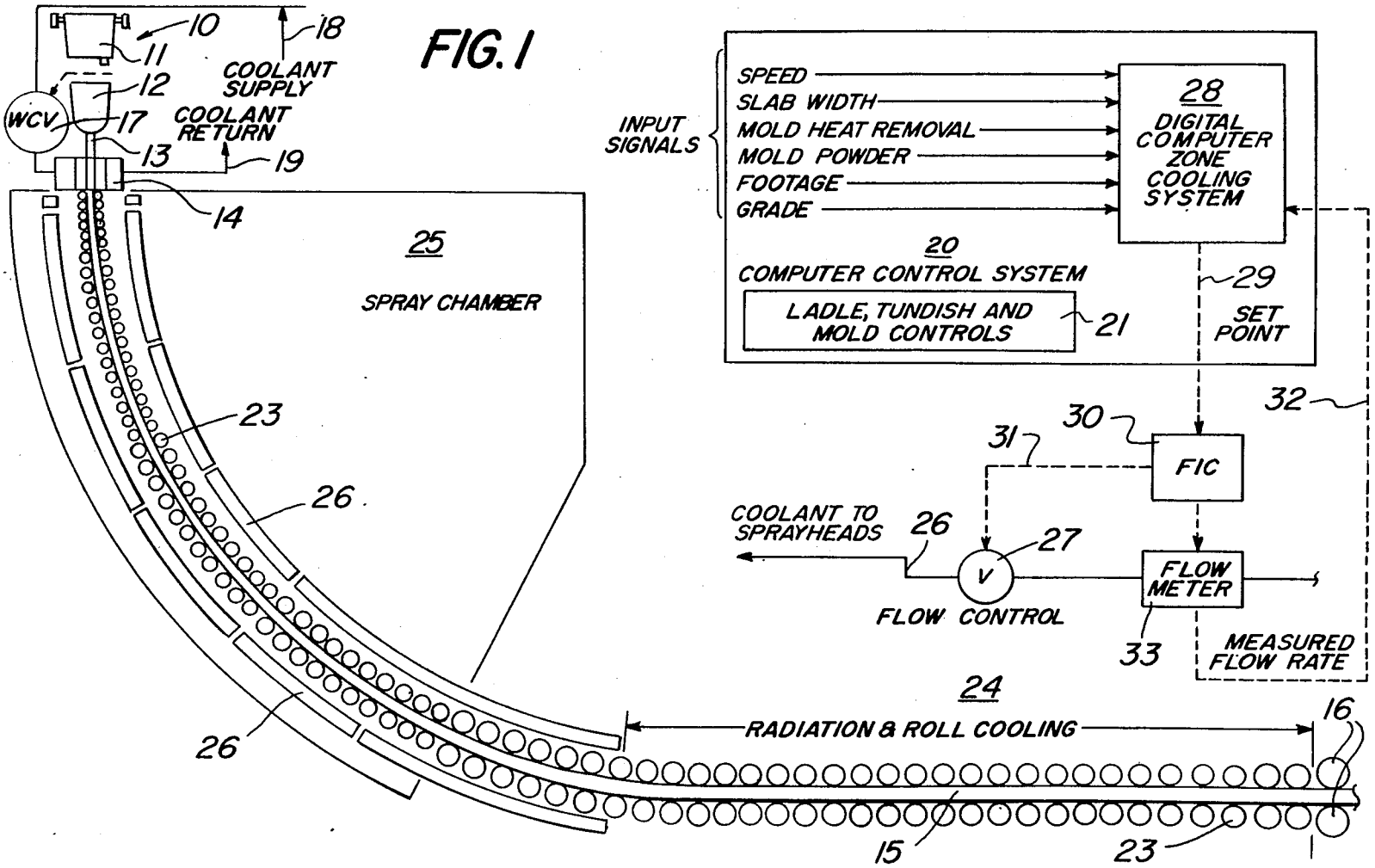
FIG. 1 is a combined system block diagram and schematic of a continuous casting system having a secondary cooling control in accordance with the present invention.

Referring to FIG. 1 there is shown a continuous metal caster 10, or simply a caster 10, which is shown after start-up, operating in essentially a steady-state mode. Super-heated molten metal was teemed form a ladle 11 into a tundish 12 and then fed controllably by shroud 13 into a caster mold 14. Mold 14 is cooled by flow regulated by flow control valve (WCV) 17, and effects solidification so that as cast strand 15 leaves mold 14 it continually consists of a liquid core and outer shell or skin of sufficient thickness to prevent a breakout.

Mold 14 instantaneous heat removal requirements vary as a function of mold hot metal level, mold size, other parameters described below, and cast strand 15 withdrawal rate as determined by pinch roll 16 operating in a preset speed control loop. In the case of mold 14 being an adjustable rectangular structure with four independent coolant flow circuits, each circuit has a flow control valve WCV interposed between coolant supply 18 and coolant return 19. The mold, ladle and tundish controls are indicated by numeral 21. Computer 20 instrumentation is exemplified by an assembly of conventional computer and control elements such as are described in detail below and also includes the spray zone cooling control system 28 of the present invention.

A measuring and computer means for determining and controlling actual mold heat removal is disclosed by Gilles and Shipman in U.S. Pat. No. 4,006,633 issued on Feb. 8, 1977 and assigned to the assignee herein.

Figure 2:
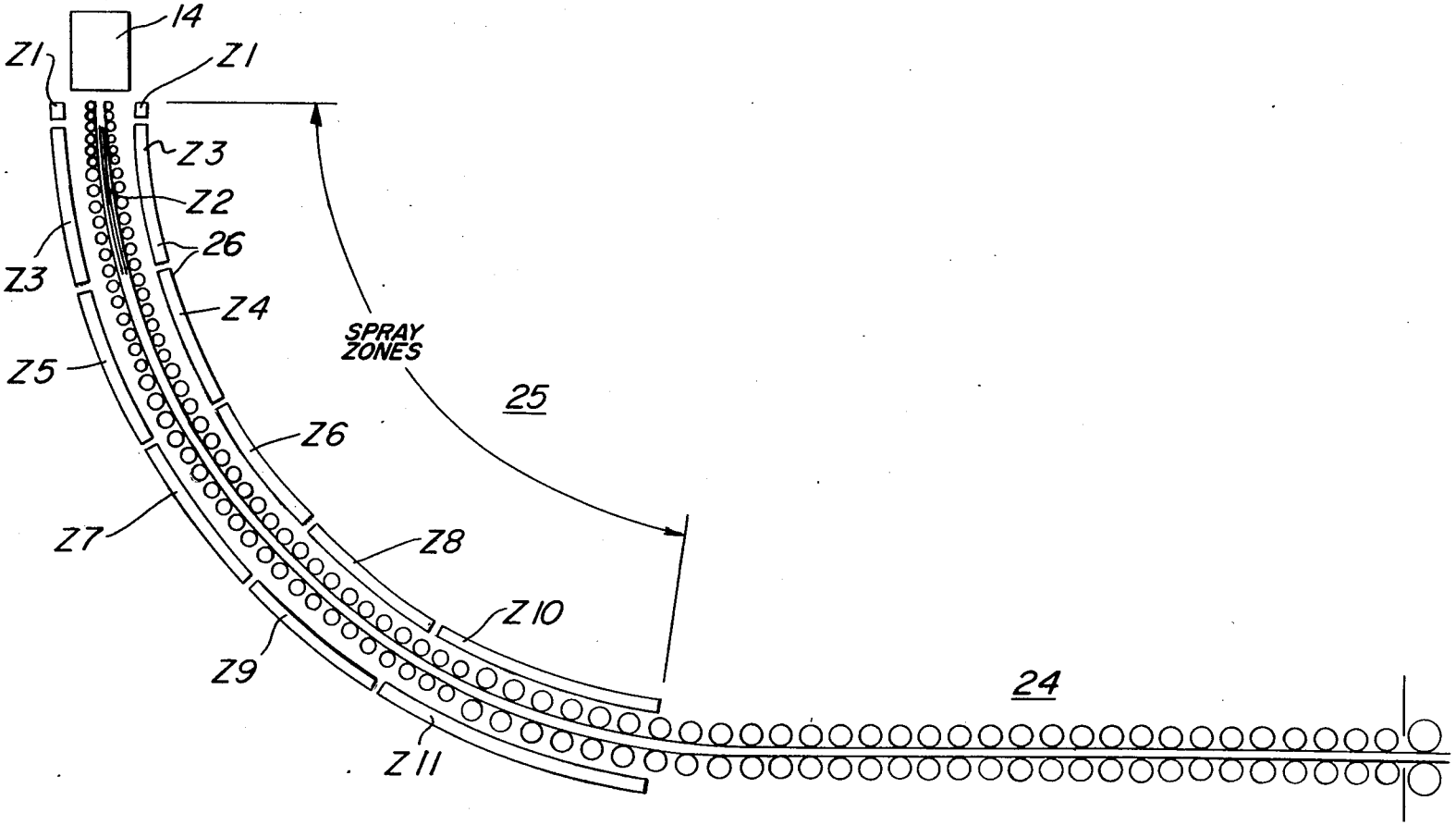
FIG. 2 is a simplified side view drawing of the spray chamber around the strand path, with the zones and spray nozzle areas shown.
Figure 3:
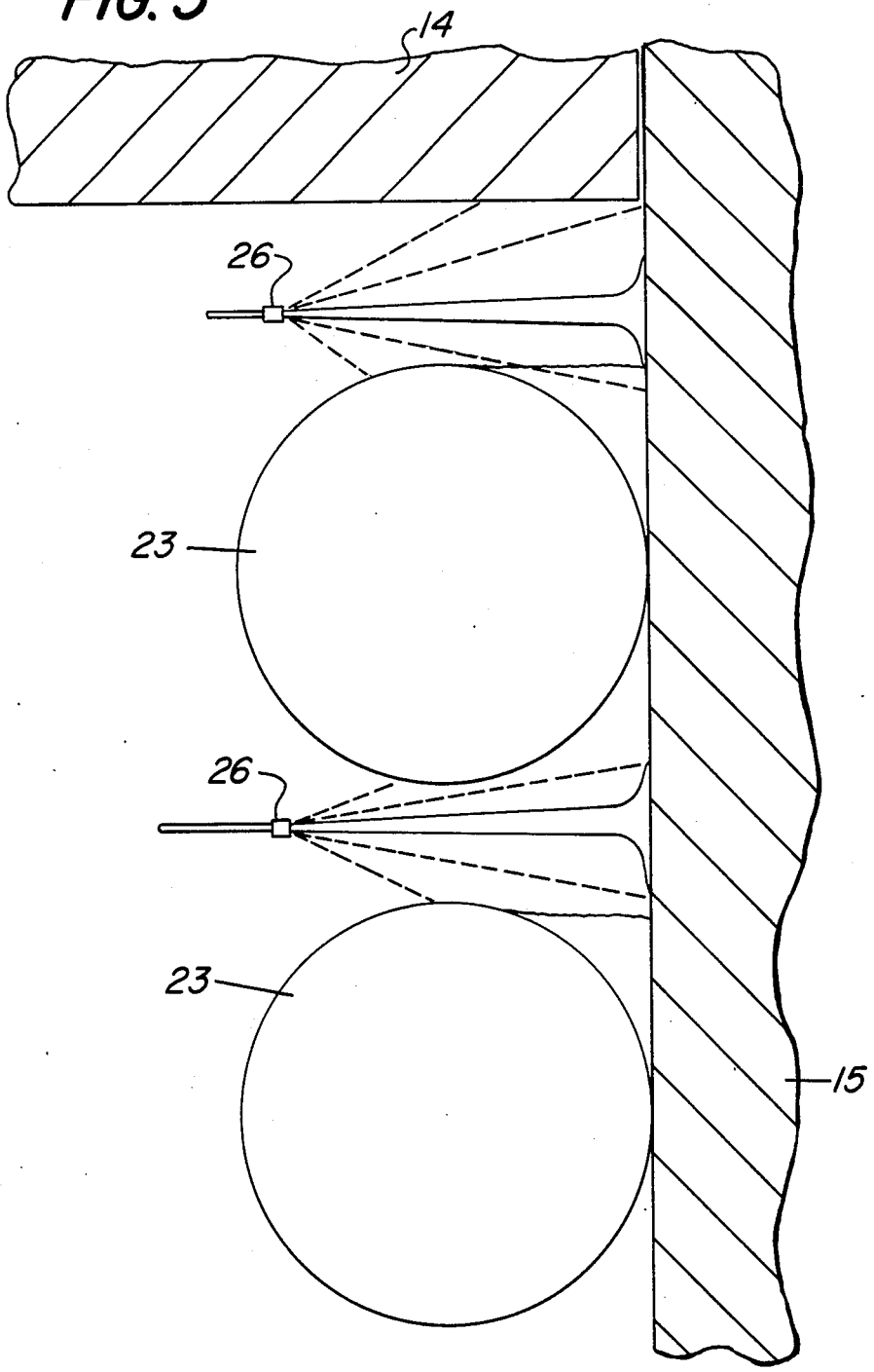
FIG. 3 shows the path of the coolant spray issuing from the water nozzles in the area below the mold and opposite to the strand surface.

Referring again to FIG. 1, the continuous casting system includes the curved mold 14 which provides a uniform shell growth, the molten steel contained in a solidified shell passing and cooled by water sprays and passing between a plurality of intermediate support rolls 23 which are internally and externally cooled and curved from the vertical toward the horizontal, such rolls 23 being supported by a structure in a conventional manner for producing a curved ingot or strand 15 to be formed and diverted into a horizontal path as defined by the rollers 23 in a radiation and roll cooling section 24. The cast strand 15 passes through a series of withdrawal pinch rolls 16 disposed along a horizontal plane for straightening the strand 15 and motor driven for withdrawing the strand 15 at the selected rate. After leaving the mold 14, the internally molten ingot or strand 15 passes into a spray cooling region defined by a spray chamber 25 within which a plurality of high velocity spray heads 26 are mounted along the path of the strand 16 with rate control valves 27 controlling the coolant, commonly water, to be sprayed onto the strand as it passes along the path in the spray chamber. Spray chamber 25 is divided into a number of zones indicated in greater detail in FIG. 2, each zone containing a set of such spray water nozzles 26 shown in FIG. 3. Cooling is carried out on a zone-by-zone basis. As shown in FIG. 2, zones Z1 to Z11 are shown and it is noted that such zones are further broken down into slices, or differential elements in the calculation of cooling for purposes of providing the most appropriate setpoint, grade and cooling data for carrying out the method of the present invention. As the steel passes through each zone, the measured specific flow, the reference specific flow and the residence time flow rate are used to determine a corrected or modified residence time flow rate. The flow rates of each of the coolant spray zones are determined by the secondary cooling control system with measured flow rate feedback loop described in detail below in accordance with the present invention. The spray water is withdrawn from the areas of the strand 16 at the downstream end of the nozzles 26 through a conventional conduit system having temperature sensors, not shown, for determining the amount of heat withdrawn in the spray cooling chamber.

Referring again to FIG. 1, a zone cooling control system 28 is provided for computing a setpoint on line 29 which provides a flow control signal to a flow-indicator-controller 30 for controlling the individual water zone valves 27 via line 31, and the measured flow from the meter 33, in each zone such that the setpoint flow is maintained. The feedforward action of the zone cooling control system is deriving the setpoint based on the conventional residence time approach and is improved by the present invention involving a feedforward-feedback system, wherein there is added to the residence time, feedforward system a feedback, shown in dotted line 32, which monitors via a plurality of flow rate measurment devices 33, the actual flow passing through each set of nozzles 26 in the zones, and feeds back such measured rate signal on feedback line 32 to the zone cooling control system 28. As will be described in more detail below, this measured value of actual cooling supplied to the strand 15 in each zone is also used in the zone cooling control system 28 to determine the additional flow control action for supplementing the residence time computer flow.

Figure 4:
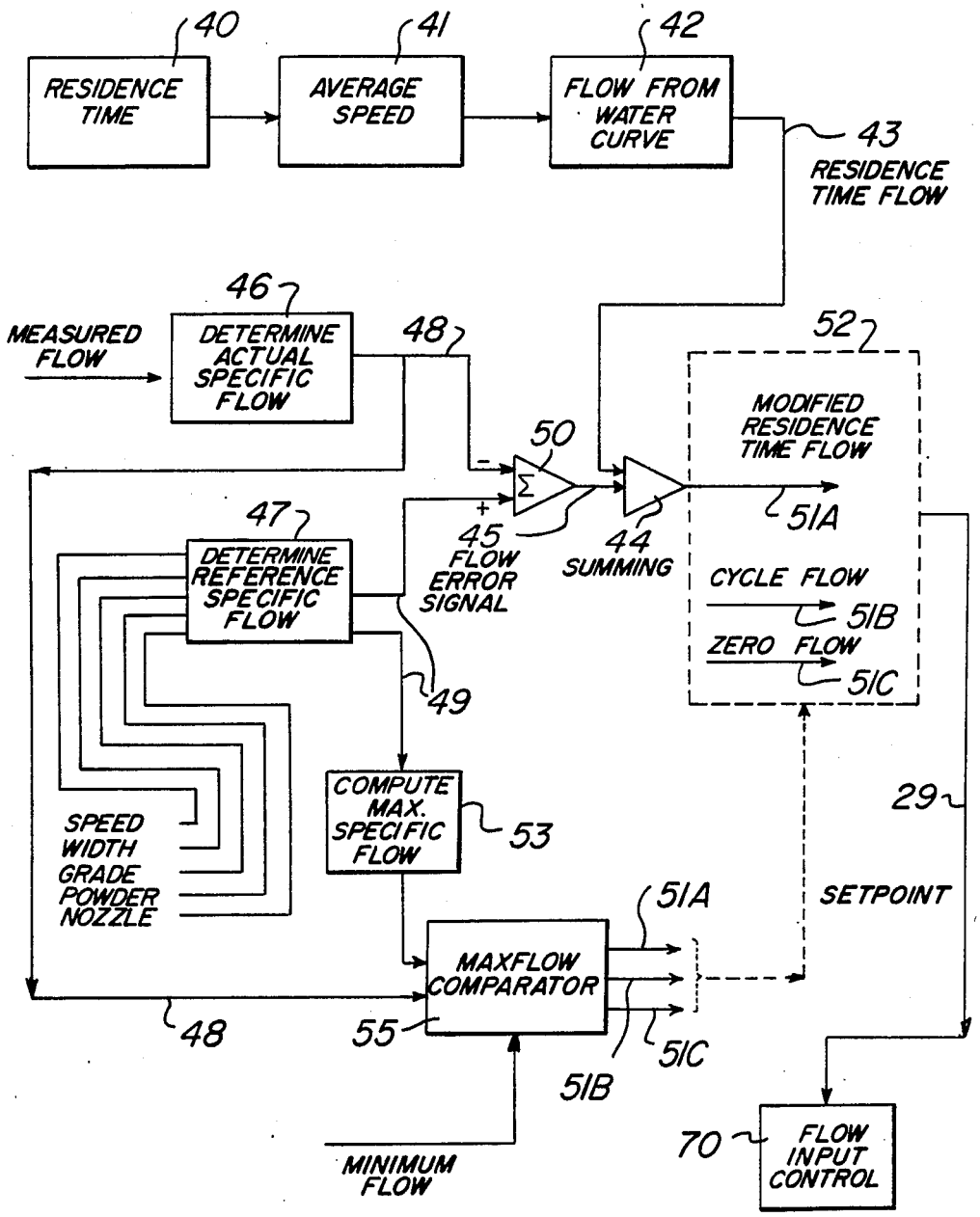
FIG. 4 is a general functional block diagram of the zone cooling control strategy shown in FIG. 1.

FIG. 4 is a general functional block diagram of the zone cooling control system shown in FIG. 1. The residence time approach is indicated in the feedforward loop wherein the residence rim 40 for strand 15 in each cooling zone is computed and used to compute the average speed in each zone, as indicated at 41. Setpoints for the secondary cooling zone flows are computed with a digital control algorithm. The primary characteristics of the algorithm are described below. Detailed logic flow diagrams for the computer code are described below. Each major function is executed through a Fortran subroutine. The residence time in a zone is determined at 40 using a subroutine RESTIM. Here, the residence time of the strand in each spray zone is determined using an array containing values of total cast length, time into the cast, and average casting speed, for all elements comprising the entire strand length generated during small time increments. The average casting speed is determined 41 by the subroutine RESTIM with the equation below.

$$\text{Average speed} = \frac{\text{Distance from Meniscus}}{\text{Residence Time}} \qquad \text{(A.1)}$$

In a pure residence time model, there is one curve for flow or relative cooling versus residence time. The residence time for a zone is used in conjunction with the single curve to find the required cooling for that zone. In an existing caster, where the steady state cooling practice has been developed over a long period of time, to minimize defect formation, it is desirable to maintain this practice with the residence time control scheme. Each zone has individual flow versus speed curves indicated at 42 in FIG. 4. For digital control, the zone residence time at 40 is converted to an average speed at 41 which is used in conjunction with the speed versus flow curves at 42 to define the zone flow on line 43. Thus, at steady state the existing cooling practice is maintained, whereas during transients, the residence time control technique maintains proper cooling.

A MAIN control in computer 20 calls the subroutines. The calculated value of cooling, in gallons per minute is provided on line 43 to a summing device 44 which also receives on line 45 a flow correction setpoint signal based on the actual measured and computed specific flows at 48 and 49. The measured specific flow (Subroutines GCALC, FLUX and AVEG) is the total accumulated quantity of specific cooling water each element of steel has received from the sprays and is computed at 46. Average values are found for each zone from all of the elements residing in the zone.

A reference aim of the specific flow (Subroutine AIMG), or the total effective quantity of specific flow, an element of steel should receive when it reaches the center of each zone is computed at 47. These values are setpoints for the feedback loops. This calculation of the reference flow at 47 includes a flow rate subroutine SWABH wherein zone flows are computed as a function of average speed, grade and section size of the elements in the zone. Correction factors are applied for start-up and mold powder effects. The reference flow calculated at 47 also includes a strand width subroutine WIDTH which determines the strand width for each zone to be used in computing flow and allows for radical or gradual width changes. The reference flow calculated at 47 also includes a subroutine GRADE which determines which grade will be used for computing the flow in a zone containing 2 different grades. The subroutine determines the position and efective length of the controlling grade for computing flows. Also the reference specific flow calculated at 47 includes a mold powder effect subroutine MOLDQ which determines a flow factor for each zone to take into account the thermal effectiveness of mold powder on secondary cooling. The thermal effect on spray cooling is estimated from the actual heat transfer rate effected in the mold by the powder.

The feedback flow control loop employs the actual measured specific flow on line 48 and compares it in amplifier 50, with the reference specific flow on line 49 to determine the error flow rate signal on line 45 used for correcting or modifying the residence time flow rates on line 43 by means of summing device 44. This produces a modified residence time flow signal on line 51A in output flow device 52. The actual measured specific flow on line 48 is also used to determine whether the system is to use such modified residence time flow or to shut off the flow. This is done by calculating at 53, from the reference specific flow, on line 49, the maximum specific flow that the system will not be permitted to exceed. This maximum reference specific flow is compared with the measured specific flow on line 48 in a decision box Maxflo Comparator 55 and, if the measured specific flow exceeds the maximum reference specific flow, the system flow will be shut off via line 51C. This is in the MAXFLO subroutine which uses the actual measured specific flow feedback for correcting the coolant flow rate and maintaining the setpoint by means of the Maxflo Comparator 55 which provides either a modified residence time flow signal on line 51A, a cycle-flow signal on line 51B or a zero flow signal in line 51C for the output flow device 52.

Thus, from the system shown in FIG. 4, the zone control strategy of the present invention improves the present residence time approach to continuous casting secondary cooling methods by adding a feedback route which monitors the actual measured amount of coolant provided to the strand in each spray zone. The measured specific flow is then used to determine the additional flow control action to supplement the residence time computed flow.

Figure 5:
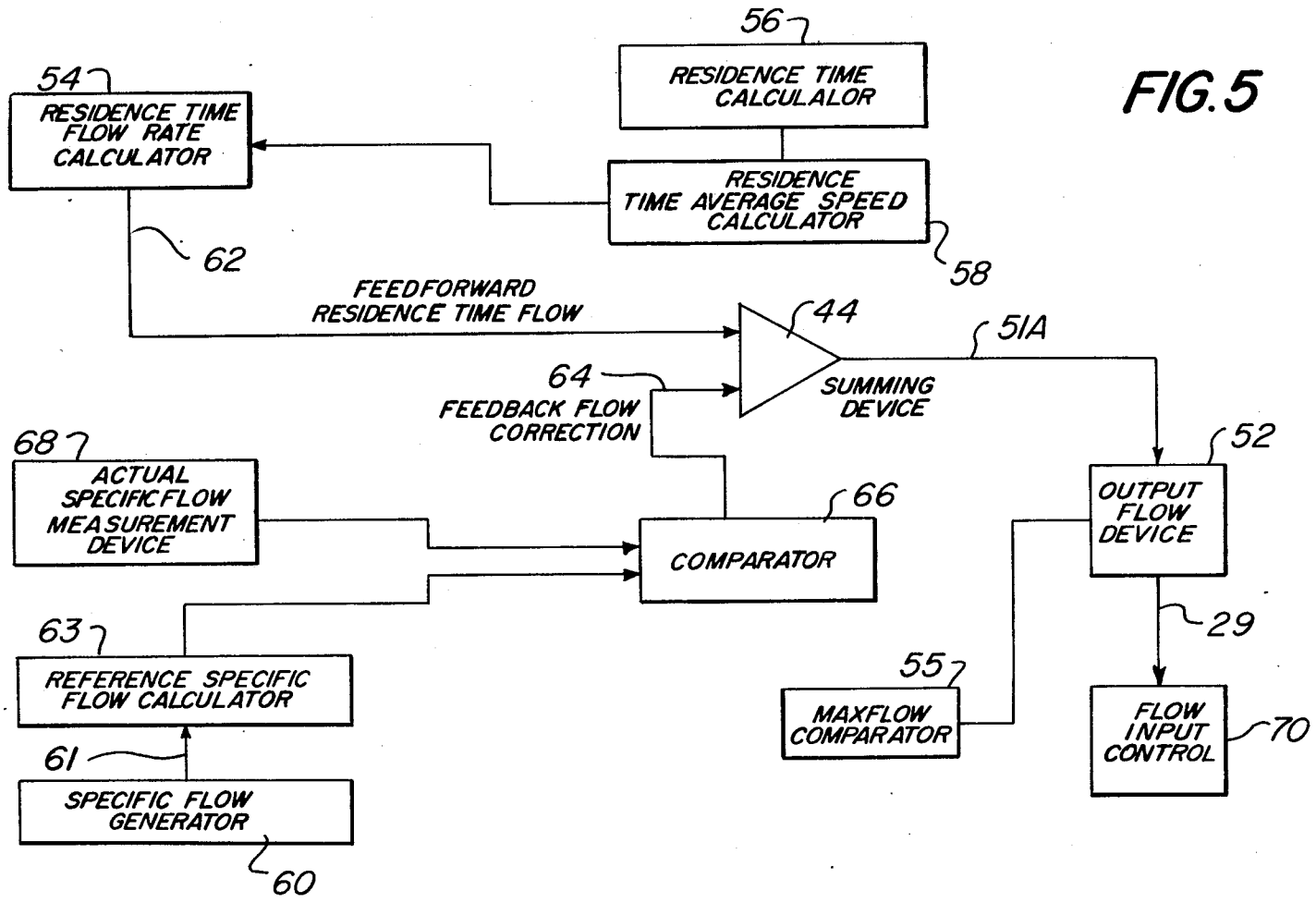
FIG. 5 is a more detailed diagram of the flow correction feedback system for correcting the zone flow setpoint.

FIG. 5 is a functional block diagram of the system for providing the spray cooling zone control strategy shown and described with respect to FIG. 4 including the feedback technique of the present invention. Flow rate calculator 54 computes the amount of cooling water required for each zone. The flow rate calculator 54 uses the residence time and speed provided respectively by residence time calculator 56 and speed calculator 58 and produces a residence time flow rate signal on line 62 to the setpoint summing device 44, as described as shown in FIG. 4. A specific flow generator 60 calculates a program subroutine AIMG which is defined as the effective quantity of specific water flow that a strand element should receive when it reaches the center of each zone. The values calculated in the subroutine AIMG become the setpoints for the feedback, cycling and shut off loops and are shown in FIG. 5 as being applied by the zone flow generator 60 via line 61 to a reference specific flow calculator 63 which calculates the reference specific flow for the feedback signal. A comparator 66 compares the reference specific flow from calculator 63 with the output of specific flow measurement devices 68 which provides a calculation of the total measured quantity of specific cooling water that each zone has received from the amount of specific water each element in the zone has received. More particularly, a water history generator receives data on each strand element and maintains a water history in terms of gallons per square foot applied in a zone. This record is maintained for every strand element.

This difference is provided as the feedback error signal out of comparator 66 on feedback line 64 to the setpoint summing device 44. In this fashion, the system applies the error between the measured specific flow and the reference specific flow to derive the feedback error for modifying the feedforward flow rate. This feedback control operation is described above as the subroutine FEEDBK wherein the aim specific flow is used as a reference or setpoint and the measured specific flow is used as a feedback signal with the feedback control applying a flow correction for maintaining the flow setpoint. The modified residence time flow signal on line 51A is operated on by decision box 55 in output flow device 52 to determine whether the flow should be further modified by cycling or whether the flow setpoint should be set to zero. The output from flow output device 52 is applied on line 29 to the flow input control 70, also indicated as the flow input control 30 to FIG. 1, for converting the setpoint signal to an individual signal for controlling the water control valves associated with each spray zone. FIGS. 4 and 5 show the method and system described above for providing the flow input control.

The secondary cooling control method provided by the system shown in FIGS. 1, 4 and 5 will now be described with respect to the flow control diagrams shown in FIGS. 10–14. Initially, the method of generating the flow setpoint will be described with respect to a mathematical model which functions in the following manner. Generally, the cooling chamber is divided into a number of zones, each containing a set of spray water nozzles, and the cooling is done on a zone-by-zone basis. The zones are further broken down into slices, or differential elements, for computation purposes. As the steel passes through a zone, a specific flow (gal/ft$^2$) is generated for each element in the zone. These specific flows are averaged, and a setpoint is produced for that zone. The dynamic modeling and control procedure has a twofold function. Namely, it must run the dynamic modeling program, and provide all interaction with, and control over the cooling process in the real world. Once heat data has been received, the dynamic molding program can be run in independent modes for each strand. It should be pointed out that certain quantities have default values enabling the model to run in the absence of data-link or manually input data. In the example used to further explain the control method certain quantities are used as follows:

| | |
|---|---|
| Strand Width | 76 inches (or last valid width reading) |
| Superheat | 40 degrees F. |
| Mold Powder | 389 |
| SPC (Spray Practice Code-defined for each steel grade) | 2 if plate grades<br>1 if strip grades<br>1 SPC is not specified |

Under the dynamic modeling procedure, the system treats each strand as if it were broken into sections or differential elements. The length of each element is configurable, with a minimum length of one inch. For each element of the strand, a specific water flow is then maintained from the time the element exits the meniscus until it leaves the cooling chamber.

The cooling chamber is divided into eleven sections, known as zones, and the cooling water is applied by zone. This facilitates a more precise control of the rate of cooling for each differential element. The dynamic model produces setpoint updates for the cooling water zones on a once per two second basis.

As each element exits the mold, a time stamp is attached to it, and the mold heat removal ratio is calculated for that element as follows:

$$R = \frac{Q(\text{measured}) - \dfrac{r \times Cp \times \text{Delta}T \times W \times t \times \text{Rho} \times s}{3456 \times (W + t)}}{Q(\text{standard})} \quad \text{(A.2)}$$

Where:

R=ratio of the actual mold heat removal to standard mold heat removal

Q(measured)=measured value of the mold heat removal r=effectiveness factor for superheat removal in the mold Cp=specific heat of the steel DeltaT=superheat W=strand width t=strand thickness Rho=density of the steel s=cast speed Q(standard)=standard mold heat removal for the given grade of steel Under normal conditions, superheat is calculated from:

Superheat=Tundish temperature−Liquidus temperature

In the event that the analog signal for tundish temperature is determined to be invalid, the default value of 40 degrees F. will be used for the superheat.

In deriving the cooling requirement for a given zone face, the model proceeds in the following manner:

(1) The flow is read from an analog flow measuring device for each zone. This is shown as step 110 in FIG. 10.

(2) The current setpoint is applied to a flow control emulator. This produces an expected flow which is then compared to the measured analog flow for the given zone. If the deviation between the measured flow and expected flow exceeds preconfigured limits, the results are provided as an on/off signal or as an alarm to a computer room printer, not shown. This is shown in steps 112, 114 and 116.

(3) The current flow is then checked to be in real limits. If the flow rate for a zone is found to be out of real limits, the results are alarmed to an event logger and to a workstation. The system will then assume the flow signal is incorrect and will use the expected flow for all further calculations until such time as the flow rate comes back in limits. At this time, the measured flow rate will be used again. If the flow rate is found at 118 to be within limits, the system will use the measured flow rate for calculations in this iteration of the math model.

Figure 11:
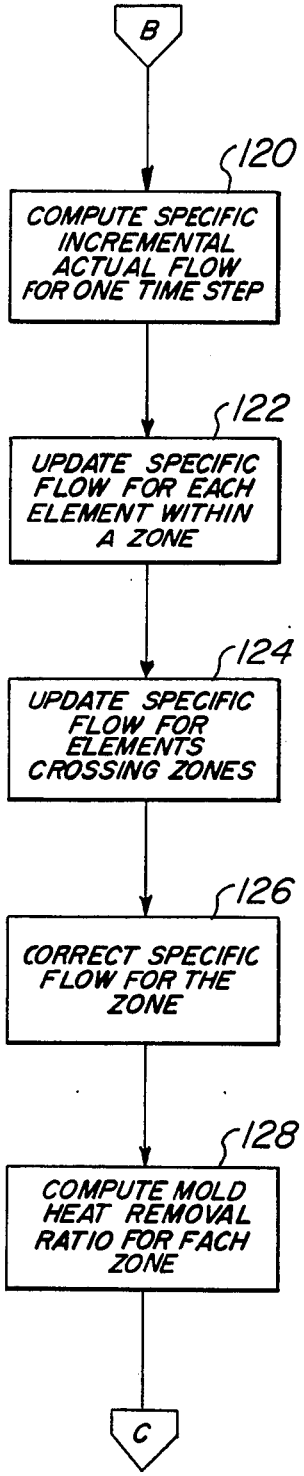

(4) The amount of water falling on a square foot for a time step in each zone (GAL/FT$^2$) is then calculated using the flow rate decided upon in steps 2 and 3 above, as shown in FIG. 11 at 120.

$$\Delta G_j = \Delta\text{GAL/FT}^2 = \frac{F \times FFACT \times \Delta T}{60 \times \text{ZAREA}} \quad \text{(A.3)}$$

Where:

F=The flow rate decided upon in the above steps 2 and 3 measured in gallons per minute FFACT=Flow effectiveness factor for a given zone face to take into account the efficiency of the spray nozzles in each zone.

ZAREA=Area of a given zone face, ft$^2$

ΔT=Time step between computations, =2 seconds j=Zone index (5) The specific flow for each element in the zone is updated thus, as shown in FIG. 11 at 122:

$$GTE(i) = GTE(i) + \Delta G(j) \quad \text{(A.4)}$$

Where: GTE(i)=the specific flow of the ith elements in the zone

It is noted that the elements crossing a given zone have their incremental specific flow multiplied by a weighting factor to correctly model the amount of water they receive from the two zones they straddle. These are updated at 124:

$$\Delta GT = \frac{F_1 \times FFACT1 \times \Delta T}{60 \times \text{ZAREA1}} \times FRACT1 + \frac{F_2 \times FFACT2 \times \Delta T}{60 \times \text{ZAREA2}} \times FRACT2$$

Where:

ΔGT=Incremental specific flow for a transition element, GAL/ft$^2$

F1=The flow rate in the first zone.

F2=The flow rate in the second zone.

FRACT1=The fractional portion of the transition element which is in the first zone FRACT2=The fractional portion of the transition element which is in the second zone ΔT=Time step between computations, 2 seconds ZAREA1=Area of the element in the first zone, $ft^2$ ZAREA2=Area of the element in the second zone, $ft^2$ (6) Calculate the average specific flow for the current zone as shown in FIG. 11 at 126:

$$GTZ = \frac{GTE(1) + GTE(2) + GTE(3) \ldots GTE(n)}{n}, \quad (A.7)$$

Where:

GTZ=the average specific flow for the zone

GTE(i)=elements in a zone (less the transition elements)

n=the number of whole elements in the zone

The GTZ for a zone is computed without the elements at each end which are crossing over into the adjacent zones.

A correction is applied to the GTZ for each zone to correct the GTZ to a value which represents the true average in the zone which would be found if the zone were completely filled with elements shown in step 126.

(7) Calculate as shown in step 128 in FIG. 11, the mold heat removal ratio for this zone thus:

$$R(n) = \frac{\text{Delta}L \times \sum_{1}^{j} (R(1) + R(2) + R(3) + \ldots + R(j))}{\text{Length}(n)} \quad (A.11)$$

Where:

R(n)=The mold heat removal correction factor for the nth zone

DeltaL=The length of a differential element

R(j)=The mold heat removal ratios for the jth element in the ith zone

Length(n)=The length of the nth zone

The zone mold heat removal ratio is used to determine a mold powder correction factor.

Figure 12:
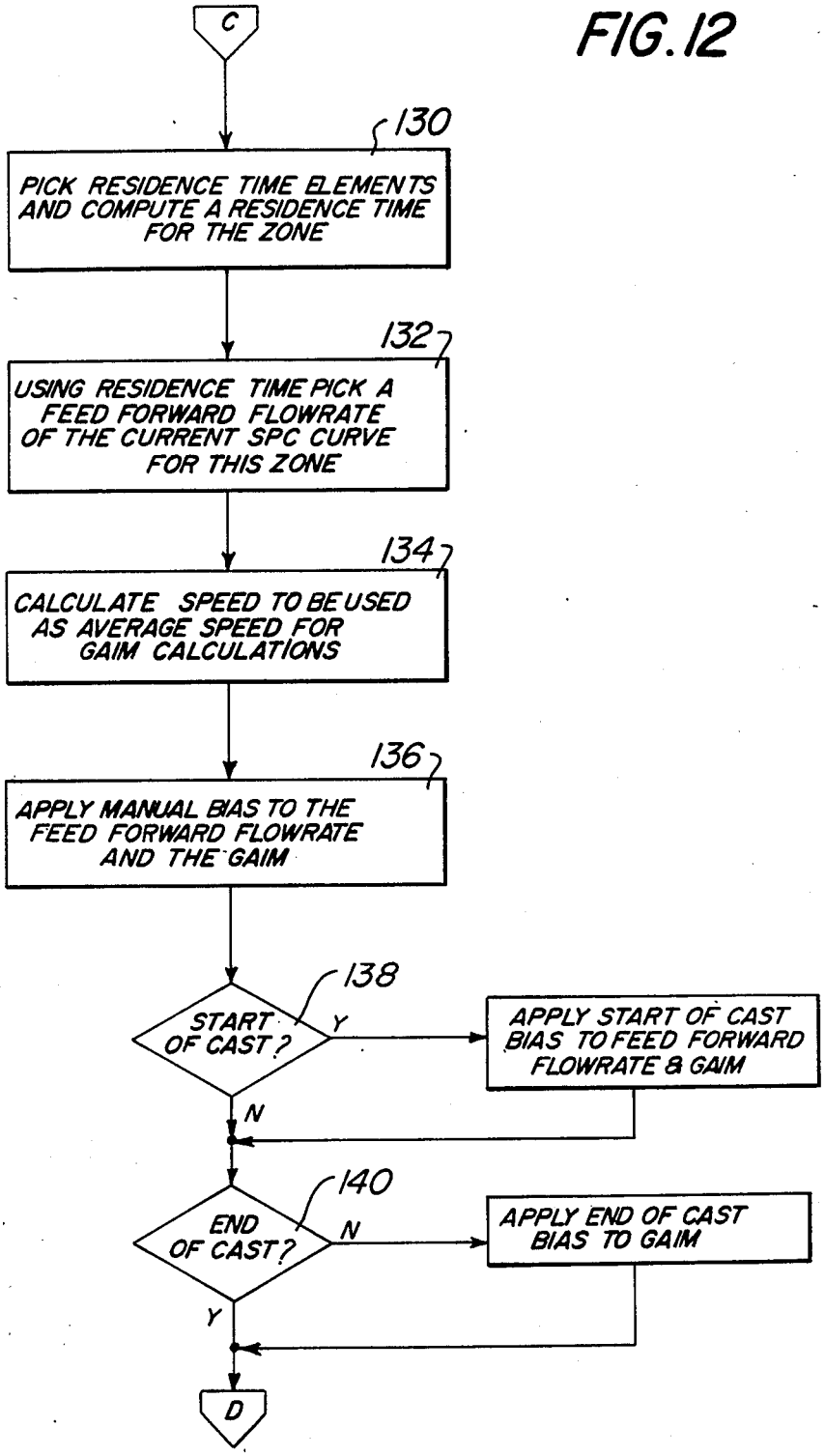

(8) Pick the elements to be used for residence time calculations (up to 9), and calculate the average residence time for this zone, as shown at 130 in FIG. 12.

(9) Using the average residence time, compute the average speed and pick a feedforward flow rate off of the current SPC curve for this zone. The SPC curve is defined by the Spray Practice Curve for a particular grade of steel. Adjust this using the average width of the zone, and the width adjustment curve for this strand, zone and grade. This is shown at 132 in FIG. 12.

Figure 13:
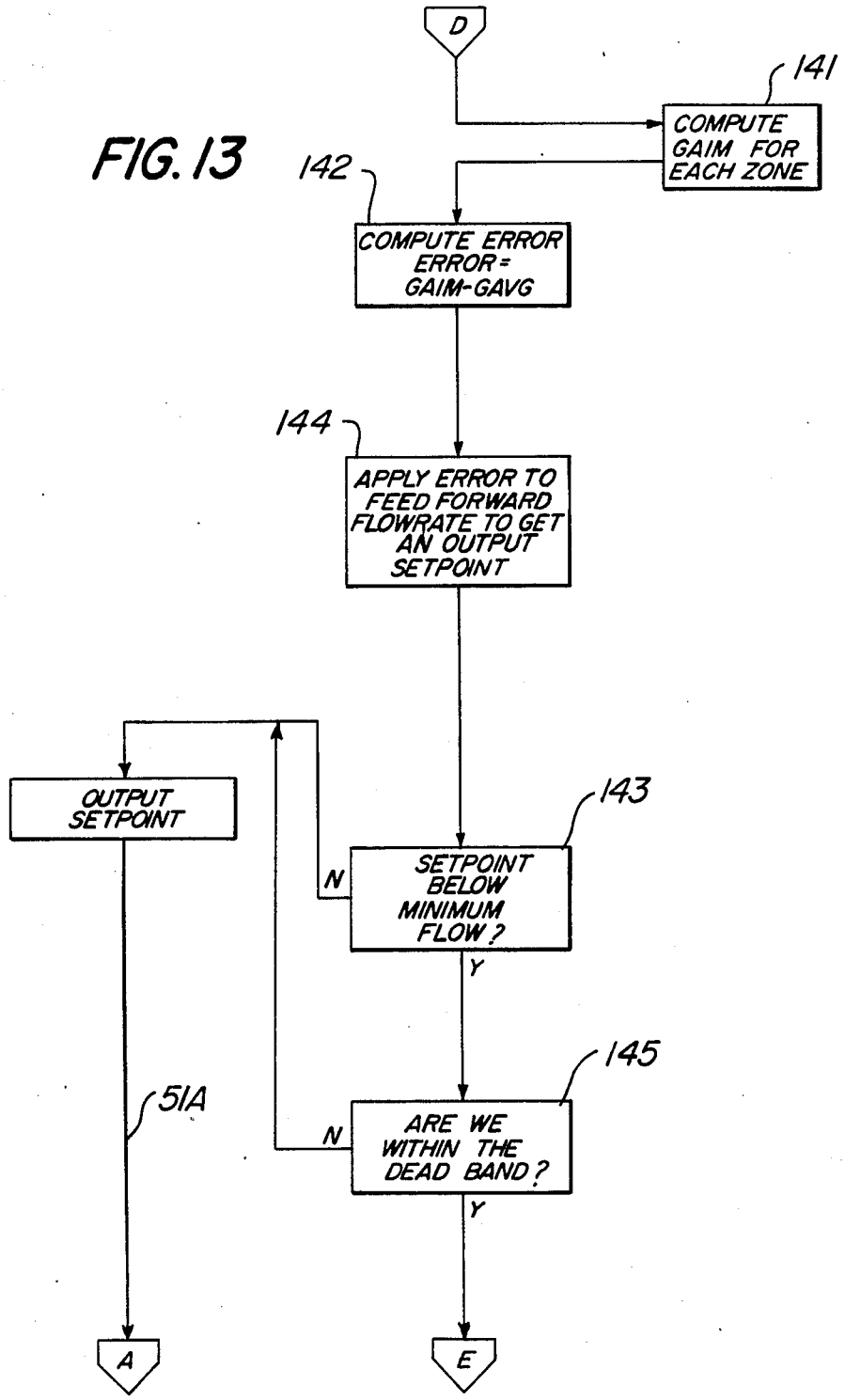

(10) Calculate the average speed of elements in the zone to be used for calculation of the specific flow in GAIM thus, as shown at 134 in FIG. 13.

$$S(i) = \frac{\sum_{1}^{M} \frac{L(j)}{\text{Theta}(j)}}{M} \quad (A.8)$$

Where:

S(i)=The average speed for zone i

M=The number of elements of the summation

Theta(j)=Residence time of the jth element

L(j)=Distance of the jth element from the meniscus. The transition elements for a zone are not included in this average speed.

The elements used for calculating Si above are:

ZONES 1, 2 and 3: every element

ZONES 4 thru 7: every 2nd element

ZONES 8 thru 11: every 3rd element

Regarding element lengths:

ZONES 1, 2 and 3: Elements are 1 inch long

ZONES 4 thru 7: Elements are 2 inches long

ZONES 8 thru 11: Elements are 4 inches long

(11) Apply the operator bias for this zone to the feedforward setpoint and to the GAIM for this zone. Operator bias is applied to 136.

(12) Apply the start of cast condition to the feedforward setpoint and the GAIM. This includes a correction of 1.0−A×EXP [B×(current run time—time to reach zone)] where A and B are constants. Values of these constants are, for example, A=0.2, and B=−0.00238.

(13) If an end of cast condition exists, apply the configured end of cast bias to the zone containing the end of the strand. Steps 13 and 14 are shown at 138, 140 in FIG. 12.

(14) Calculate the GAIM for this zone as shown by step 141 in FIG. 13 thus:

$$\text{Delta}GAIM(i) = \frac{F(i) \times \text{Delta}L(i)}{A(i) \times S(n)} \quad (A.9)$$

$$GAIM(n) = \sum_{i \times i=1}^{i \times i=n-1} \text{Delta}GAIM(i) + \frac{\text{Delta}GAIM(n)}{2} \quad (A.10)$$

Where:

DeltaGAIM(i)=The change of cooling for the ith zone

F(i)=Effective flow rate for the ith zone

DeltaL(i)=Zone length for the ith zone

A(i)=Effective area of a given face for the ith zone

S(n)=The average speed of the elements in the nth zone from equation A.8

DeltaGAIM(n)=The change of cooling for the current zone under consideration

GAIM=Accumulated cooling for the current zone under consideration n=current zone under consideration The aim cooling for a zone n, GAIM(n), is a function of all factors that influence strand cooling. It is computed by assuming that the steel in zone n, during any time increment, has passed through the machine while having the characteristics that exist in zone n during that time increment. Thus, for steel in a zone, the following are defined:

R(n)=average mold heat removal ratio

S(n)=average casting speed (IPM)

Grade (n)=critical grade

W(n)=average width, In

Assuming steel with these characteristics is passing through the machine, flows, F(i), for each zone up to and including zone n are determined. The mold heat removal zone coefficients are applied for each zone. Likewise, the current value of the operator bias is also applied.

(15) Calculate the error between the zone GAIM and the average measured specific flow for the current zone GAVG, at 142 in FIG. 13.

(16) Apply the error to the feedforward flow rate to produce an output setpoint. The error is applied at 144 of FIG. 13 and the output setpoint appears at line 51A shown in FIG. 4.

(17) If the calculated setpoint for a given zone is outside the preset limits, determined at 143 and 145 in FIG. 13, the output setpoint will be cycled between a maximum and minimum (zone/strand configurable) pair of limits. Cycling is initiated only if a cycle permit flag is set at 150. The output signals are at 51B.

Figure 14:
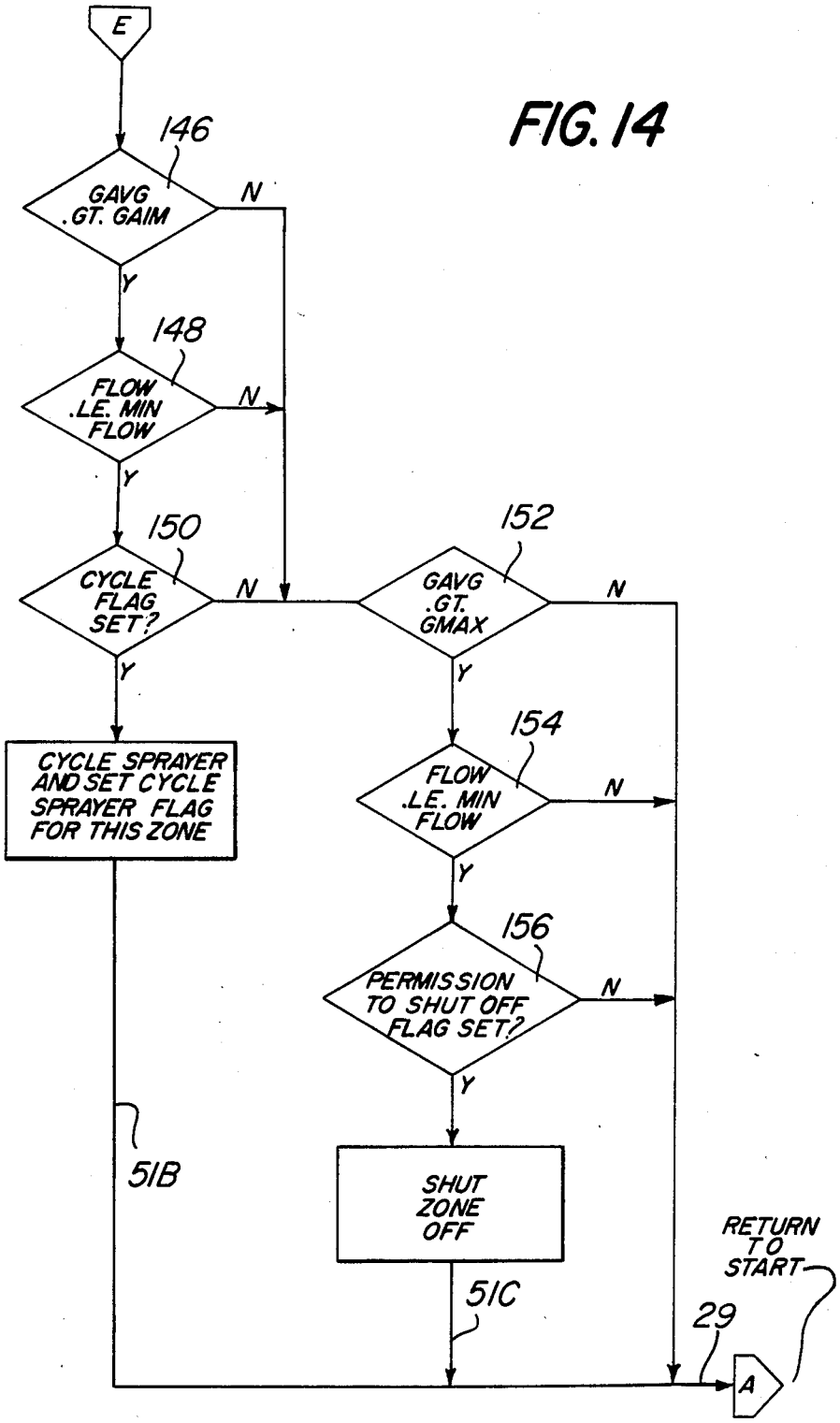

If other criteria are met in steps 152, 154 and 156 shown in FIG. 14, the flow will be shut off, and the output signal will be at output line 51C. This final output setpoint is shown in FIGS. 1, 4, 5 and 6 as being generated on line 29.

Figure 6:
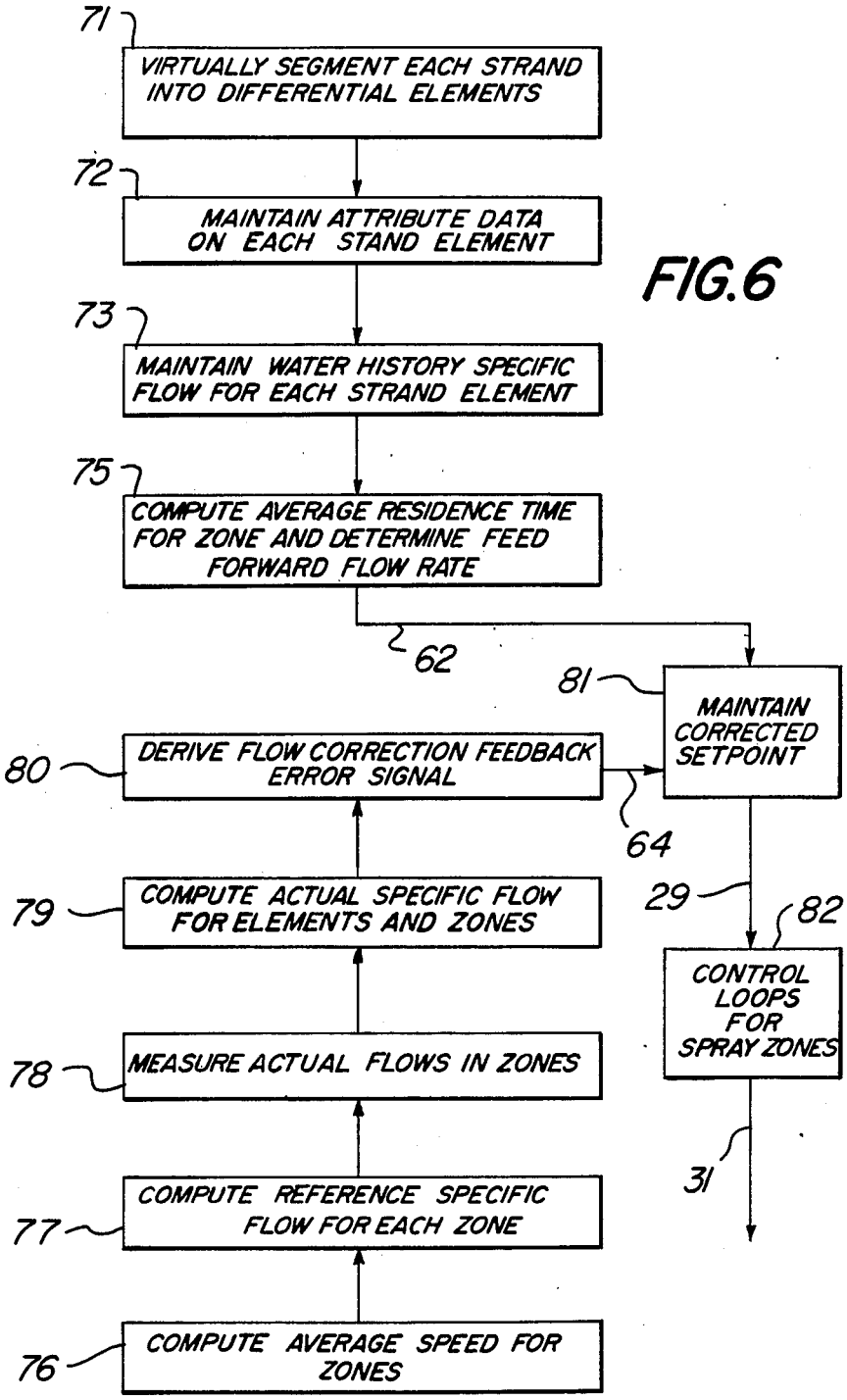
FIG. 6 is a flow diagram of the zone flow-control method of the present invention.

Referring to FIG. 6, there is shown a flow diagram of the zone flow control method in accordance with the present invention are used in the system as described above. Here, the steps 71 through 77 include a list of the tasks which must be undertaken by the modeling software while in the dynamic mode. These tasks, or steps, are described above in connection with the FIGS. 1 through 5, and are also described above in the example of the dynamic modeling procedure. In step 71, each strand is treated as being virtually segmented and is conceptually broken into a configurable number of differential elements. The minimum length of each element is, for example, one inch. In step 72, there is maintained an array of attribute data on each differential element from the time the element is born at the meniscus until it exits the spray cooling zone. Its birth time, grade and width are recorded when it leaves the meniscus. When an element has completely cleared the mold, its mold heat removal ratio is calculated. In step 73, there is maintained a psecific flow for each differential element, showing the gallons/square foot which has been applied to an element from the time it entered the first spray zone to the present time. All attributes and specific flow are used in calculating the amount of cooling required by the strand. In step 75, the average residence time for each zone is calculated and the feedforward flow rate is determined.

An operator biased setpoint for each zone in the strand has a bias which will be programmable by the following equation:

$$\text{Operator Bias Factor} = 1 + (SB \times ZB)/10000 \qquad \text{(A.12)}$$

where SB is the manually input strand bias in the range of plus or minus 100%, and ZB is the configured zone bias which is in the range of zero to 100%.

The average speed of the strand elements through the zones is calculated in step 76 using equation (A.8). In step 77, there is calculated the amount of accumulated cooling water required for each zone by program subroutine GAIM.

The actual cooling flow is measured in step 78 and used to compute in step 79 the specific water quantity actually received by each strand element and the average values of these computed and measured quantities for each zone. Such measured and computed values are compared in step 80 to derive a flow correction feedback error signal on line 64. This signal on line 64 is applied in step 81 to the feedforward setpoint signal from line 62 to provide a modified residence time flow, which may be modified further by cycling or completely shut off, as in steps 66, 44 and 46 in FIG. 5, to thereby maintain a corrected setpoint on line 29 which in turn is applied in step 82 to control the nozzle valves for the zone sprays.

Figure 7:
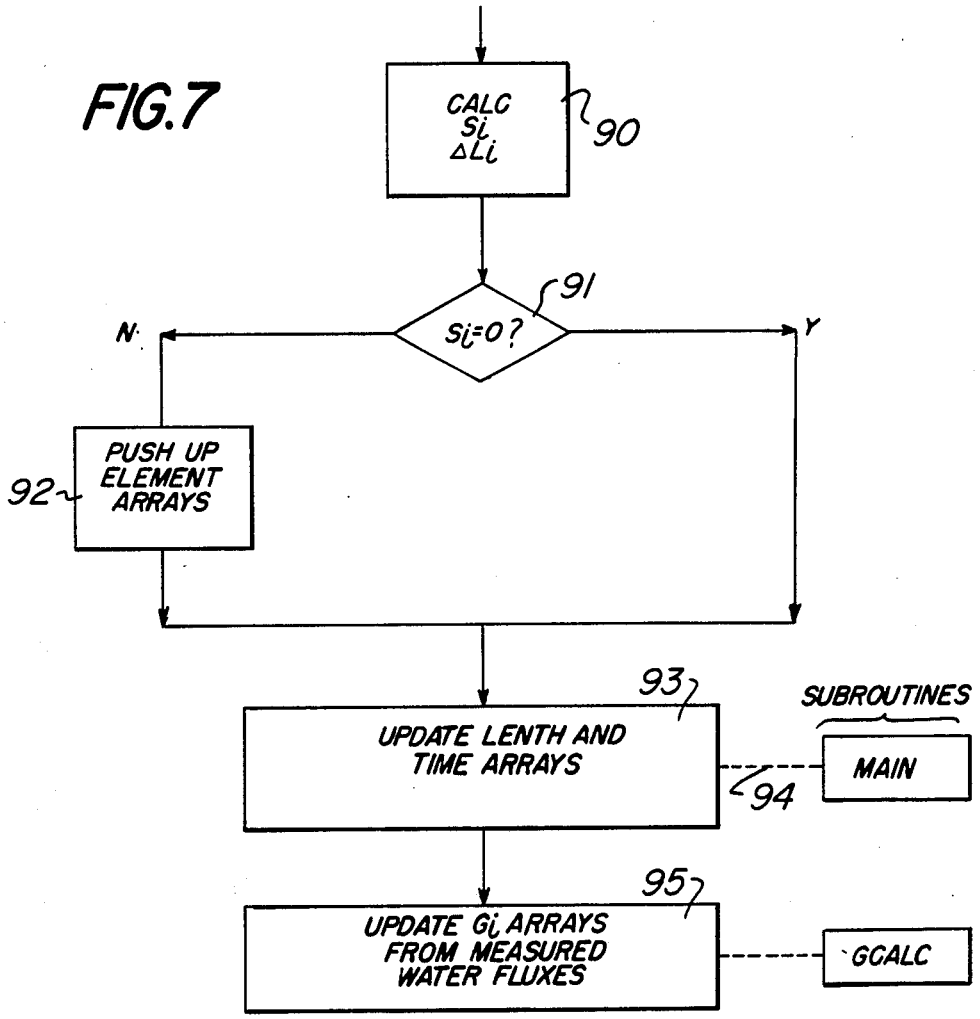
FIGS. 7, 8 and 9 respectively are the control program functional flow diagrams for calculating and updating the speed, length, time and coolant flow arrays for each time step and for each spray zone.
Figure 8:
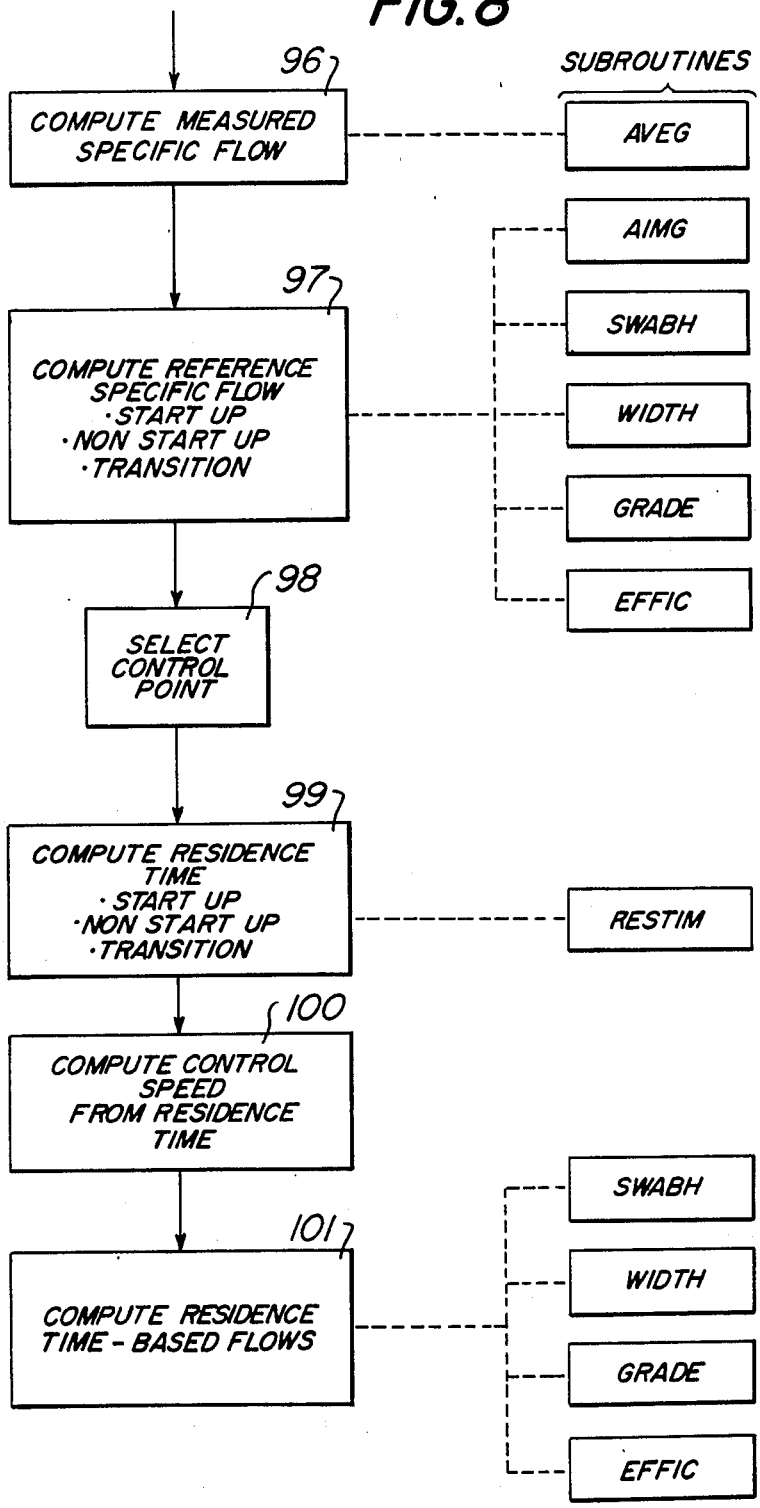
Figure 9:
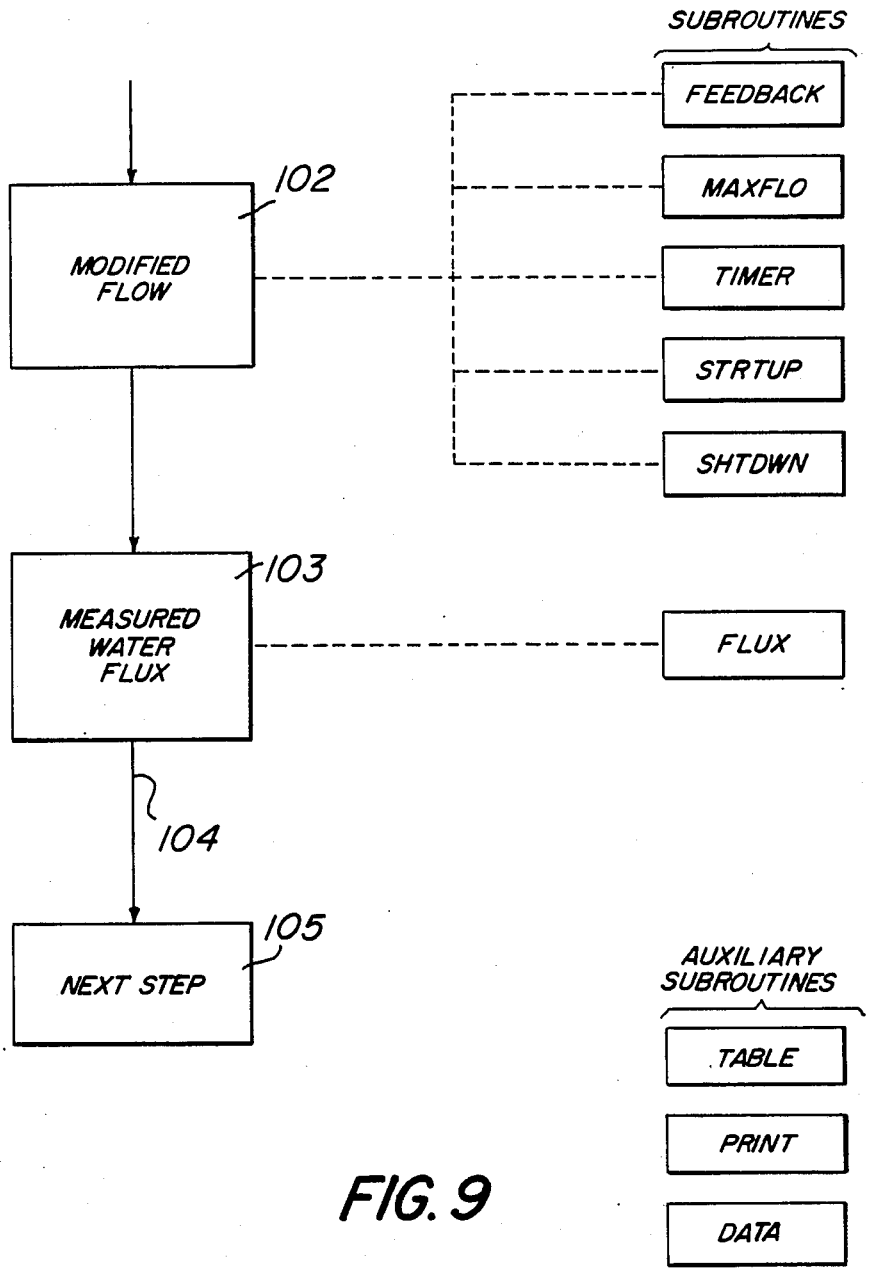
Figure 10:
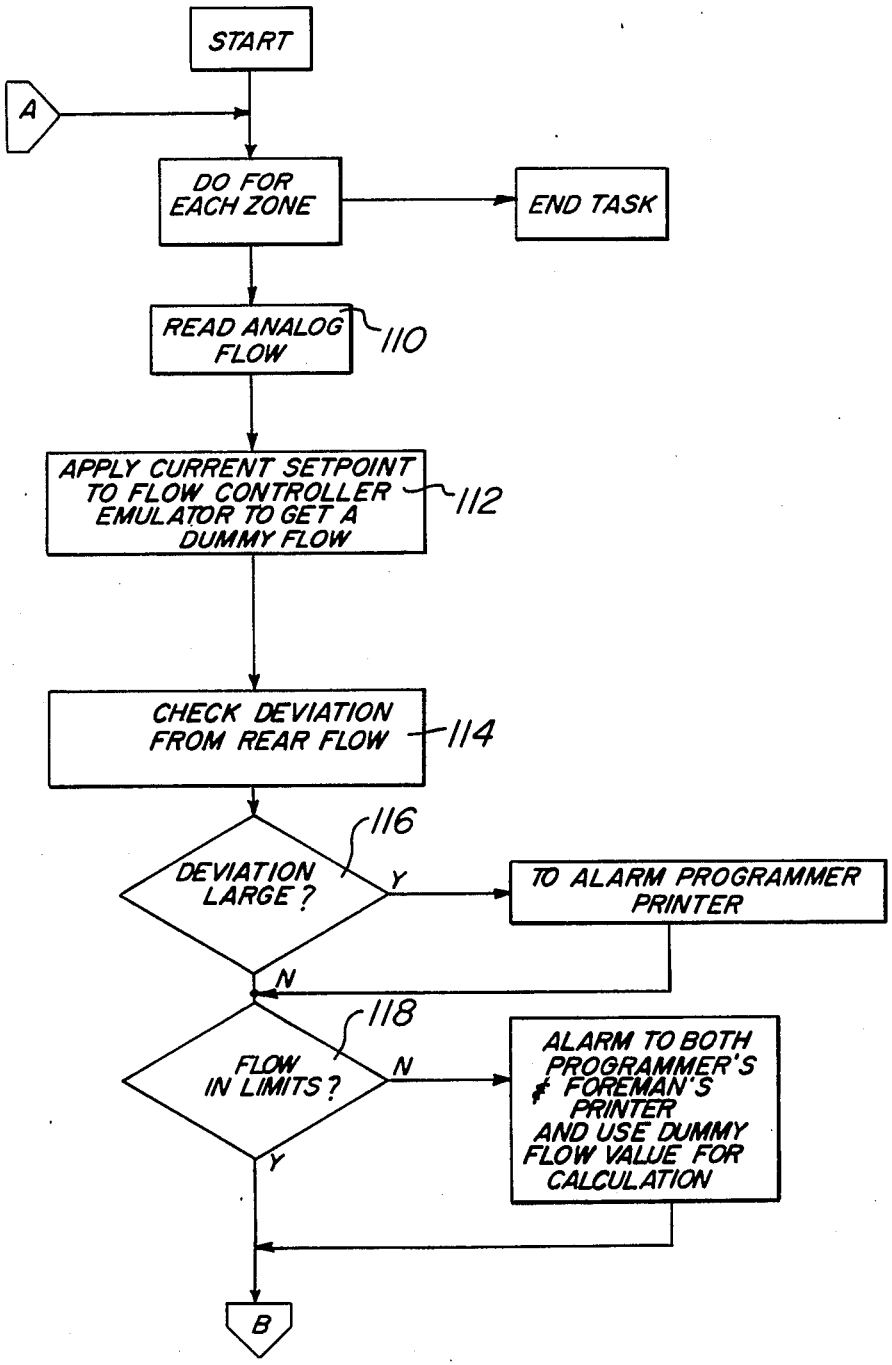
FIGS. 10, 11, 12, 13 and 14 are flow diagrams of the dynamic modeling and control program for deriving the cooling requirements and feedforward setpoints for each zone in the strand.

FIGS. 7, 8 and 9 are flow diagrams of the control program used in the zone cooling control system 28 for each time step, i, such as two seconds. Generally, as described above, the feedforward control involves each slice or element of the steel strand 15 being cooled as a function of the residence time in the machine. The feedback control shown and described above involves using the actual quantity of water that is sprayed on each slice or element of steel to monitor and correct for deviations from the desired control procedure. There is shown in FIGS. 7, 8 and 9, connected by broken lines to the right of each functional block the subroutine used for each control step. For the steel element arrays, the average speed Si is calculated as a function of time at 90 and, when the average speed Si is not equal to zero at 91, the element arrays for time into the cast, average speed, width, inches into the cast, time for the meniscus, distance from the meniscus, length of the element, mold heat removal factor, and specific flow, are advanced and the attributes of the newly formed element are computed at 92. The length and time arrays are updated at 93. The element arrays are used layer for calculating the average width, heat removal factor, speed, head end, and crossing element and summing the water flow and element length for a given zone. The calculations shown at 93 are referred to as the MAIN program and indicated by the broken line connection 94. The specific flows Gi on all elements are updated from the zone water fluxes in subroutine GCALC shown at 95.

The control program for each of the spray zones in shown in FIG. 8 wherein the subroutine AVEG calculates at 96 the average specific flow G measured for each zone and then corrects the specific flow G to the midpoint of the zone. Since elements crossing zones are not used in the comuptation of the average, and elements may not be symmetrically located in the zones, the true mid value must be corrected to the center of the zone. The GCALC, FLUX and AVEG subroutines are used to determine the measured specific flow by computing the total quantity of specific cooling water each element of steel has received from the sprays, and the average values are found for each zone by step 96 shown in FIG. 8. After the average specific flow for each zone is calculated, the subroutine GAIM calculates at 97 the aim, middle and maximum gallons per square foot for the zones as well as calculating by subroutine SWABH the flow setpoint for a zone, using width, grade and other factors. These subroutines, AIMG, SWABH, WIDTH and GRADE are described above in connection with the FIG. 4 and the main control in the computer shown in FIG. 1. Subroutine EFFIC representing the spray nozzle effectiveness which converts the water flow rate into an effective amount of strand cooling by allowing for differences in nozzle performance with a factor applied to the flow for each zone. The select control point at 98 is used by subroutine RESTIM to calculate at 99 the residence time of the strand in each spray zone. Control points can be at a specific location in a zone or an average of a number of locations in a zone. This calculation takes into consideration the conditions such as start-up, a nonstart-up condition, or a grade transition of the strand 15. The control speed is calculated at 100 from the residence time and a subroutine SWABH calculates the flow setpont for a zone using factors such as width, grade and efficiency for calculating at 101 the residence time based flows.

Referring the FIG. 9 there is generally showwon the feedback subroutine for calculating at 102 a modified flow for correcting the zone flows based on the specific flow derived from the measured flows from the flowmeters. The calculation of the modified flow at 102 includes feedback control by the subroutine FEEDBK which uses aim specific flow and measured specific flow to determine a feedback signal and applies a flow correction to maintain the setpoint. The calculated modified flow at 102 also includes maximum cooling by a subroutine MAXFLO which causes zones to be turned off when the maximum amount of a specific flow has been achieved. Maximum cooling is a function of grade, width, average speed, mold heat removal factors, and zone. A deadband range eliminates excessive on-off action. Also, there is provided flow cycling by a subroutine TIMER which insures that in certain upper zones near the mold, the water remains on at a sufficient percent of the time to cool the rolls. To produce effective water flow rates less than minimums need for nozzle operation, the flow is cycled on-off as a function of the total amount of cooling received by the strand in the zone by the subroutine TIMER. In the subroutine STRTUP, there is applied a time dependent factor to the zone flow to allow for a gradual decrease in cooling of the strand by the heating up of the cold rolls and cold spray water until thermal equilibrium is reached. Here, flow is reduced due to cold start factors in each zone. A shutdown subroutine SHTDWN turns off the flows to each zone after the tail of the strand clears the zone at the end of a cast sequence. A subroutine FLUX is used at 103 to calculate the measured water flux in each zone based on the actual measured flows.

In FIG. 9, the operation flow line 104 after the step 103 of calculating the measured water flux proceeds to the next step 105 of the feedback flow correction for each zone. Some of the additional subroutines include a subroutine CSTEND which modifies zone, AIM, MID and MAX specific flow G as the strand tail passes through zones during the end cast condition. A subroutine FLOEND sets the flow setpoint to zero if the tail is past a zone during an end cast condition. A subroutine VALVE calculates the expected actual flow in zones based on setpoints and simulates controller valve responses. A subroutine RCALC calculates ratio of measured heat removal to standard heat removal for grade and powder effects. A subroutine TABLES provides input data lookup, while plotting subroutines generate various output plots, also, an OUPUT subroutine generates output listing of speed, G, flows for each zone and time steps.

Figure 15:
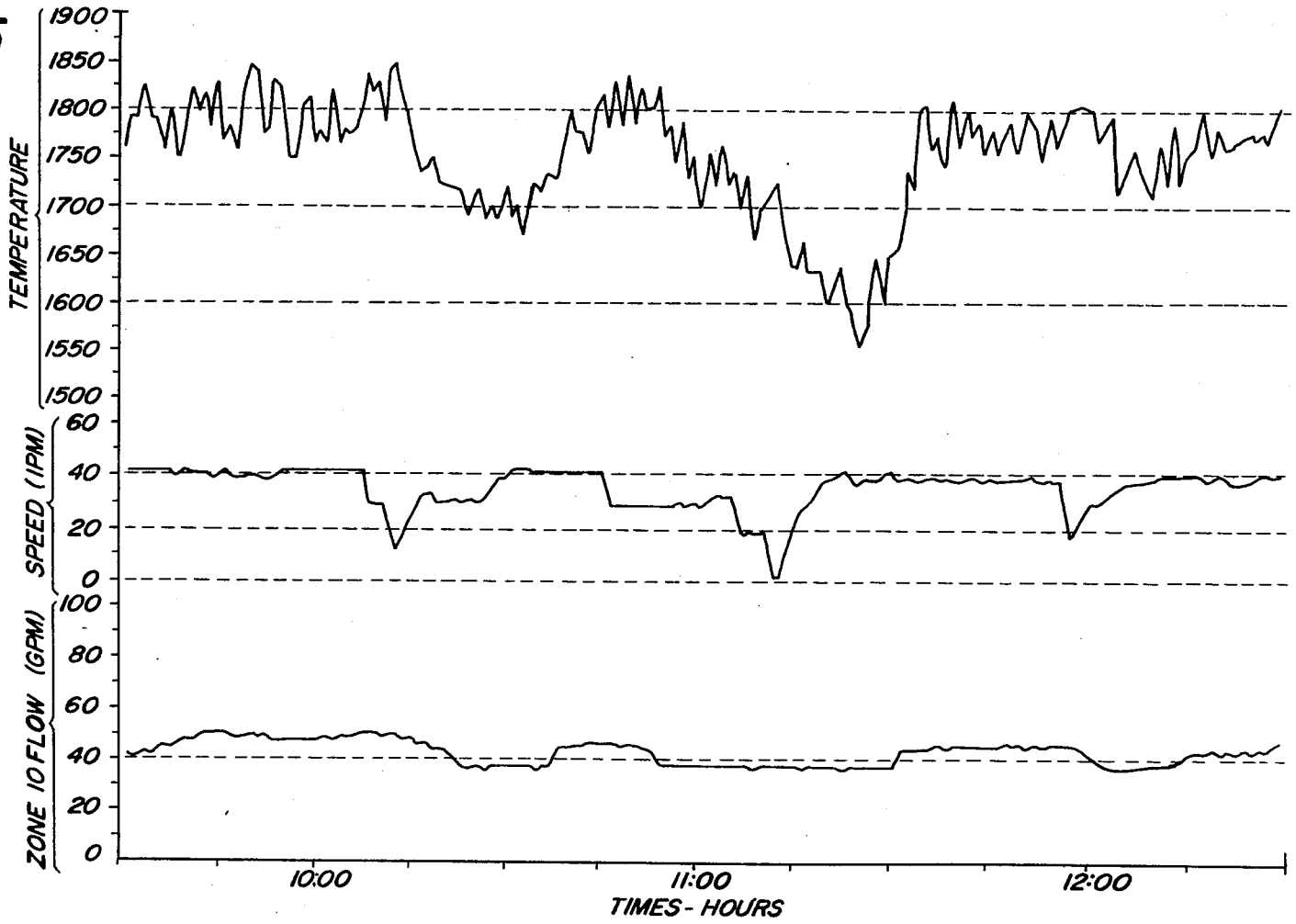
FIGS. 15 and 16 are analog strip chart records which recorded temperature, speed and water flow in zone 10 against time.
Figure 16:
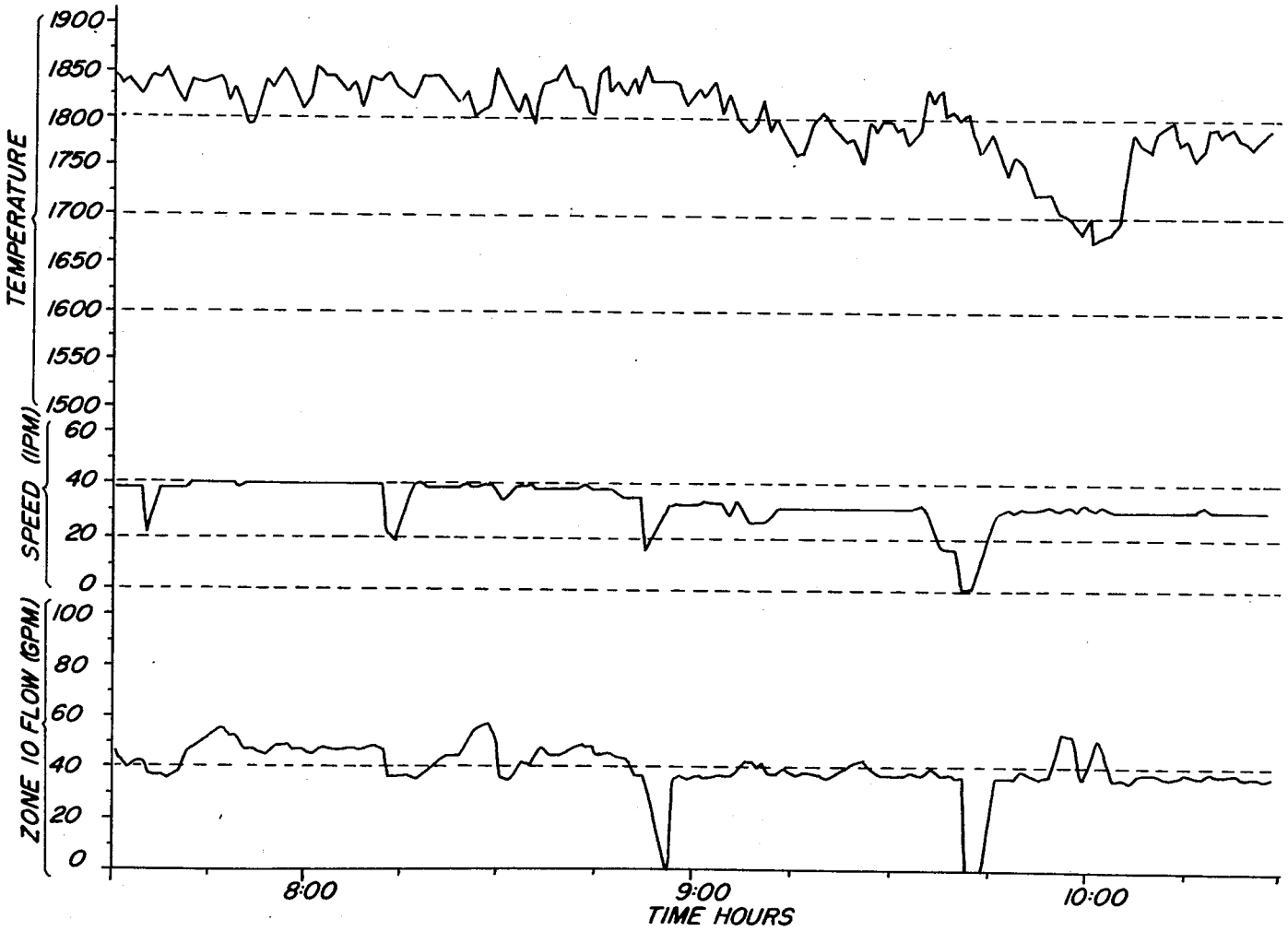

I have developed a microprocessor program for carrying out the functions of the system elements described above. The program is carried out using an August Systems Inc., Model CS306, microcomputer with the application program coded in Fortran. The microcomputer is supported with two Intel 310 work stations and two conventional monitors. The computer control systems have been tested on a slab caster which has two strands capable of casting slabs 10 inches thick and 32 to 76 inches wide, and generally produces 2.1 million tons of steel per year. An example of the effectiveness of the control system is shown in FIGS. 15 and 16. FIG. 15 represents actual operating data using a modified analog control system which causes flow in each zone to be a function of the residence time of the steel in the zone. In this case, the flow is not permitted to drop below a preset minimum. As can be seen in the FIGURE, when the casting speed decreased to a low value, the flow in the zone drops to a minimum value and stays there. The temperature just beyond the end of the cooling chamber drops to below the minimum acceptable temperature of 1600° F.

FIG. 16 is an example of using the above described digital dynamic secondary cooling control scheme with feedback correction and shutoff of zones in accordance with the present invention described above. In this case when the speed is reduced, the temperature drops by a small amount maintaining a value substantially above the required minimum of 1600° F.

While the invention has been described above with respect to its preferred embodiments, it should be understood that other forms and embodiments may be made without departing from the spirit and scope of the invention.

What is claimed is:

1. Method for cooling a continuous casting in a cooling area that is divided into a plurality of zones in which cooling water spray nozzles are located, comprising:

determining a residence time computed cooling water flow rate that an element of steel should receive in each cooling spray zone if traveling at an average casting speed computed from the residence time in said zone;

measuring the total specific flow of cooling water that each element of steel has actually received in each spray zone; calculating a reference specific flow in a spray zone related to the average speed, grade, section size and mold heat removal;

comparing the computed reference specific flow in each zone with the measured specific flow of cooling water actually received in each said zone to produce a coolant flow rate correction feedback signal; and modifying said computed residence time zone flow rates by said coolant flow correction feedback signal.

2. Method as recited in claim 1 further comprising calculating a maximum specific flow, determining if said measured specific flow exceeds said maximum specific flow, and shutting off said cooling water spray nozzles to stop said coolant flow when said measured specific flow exceeds said maximum calculated specific flow.

3. Method as recited in claim 1 wherein said cooling is carried out on a zone-by-zone basis, with said zones being further broken down into differential elements.

4. Method as recited in claim 1 wherein said step of calculating a reference specific flow includes determining a reference specific flow that an element of steel should receive when it reaches a known point in each cooling zone where said reference specific flow is a function of average speed, grade and section size of each element of steel casting.

5. Method as recited in claim 1 wherein said step of measuring the total specific flow of cooling water includes computing the quantity of specific cooling water actually received by each steel strand element of said casting and averaging the values for each cooling zone.

6. Method for cooling a continuous cast steel in a cooling area, where said area is divided into a plurality of zones in which cooling water spray nozzles are located, comprising:

developing a history of the average quantity cooling water sprayed through said nozzles for each said zone;

determining a reference aim value based on said history of the specific quantity of cooling water that an element of steel should receive when it reaches a known point in each cooling zone and providing said reference values as the feedforward flow rate setpoints for a feedback loop, said reference setpoint aim values being determined as a function of average speed, grade and section size of said elements of steel;

determining the total measured quantity of specific cooling water each element of steel has received, and calculating the average measured values for each zone;

calculating the flow correction error between said calculated amount of cooling water required per each zone and said average water history measured for a current zone; and applying said flow correction error as a feedback signal to said feedforward flow rate setpoint to produce a feedback corrected setpoint signal for adjusting said spray nozzles for maintaining the required setpoint aim values of cooling water on each said elements of steel.

7. Method as recited in claim 6 wherein said cooling is carried out on a zone-by-zone basis, with said zones being further broken down into differential elements, and said setpoint is produced by generating a water history for each steel element in said zones and averaging said water history to produce setpoints for the secondary cooling zone flows which are computed with each strand being broken down into said differential elements.

8. A method of cooling a continous cast steel in a cooling chamber than is divided into a plurality of zones containing spray water nozzles, comprising:

determining for each element of casting steel the steel residence time in each cooling spray zone of the secondary cooling zone, using the residence time for each zone to determine the required cooling for that zone, controlling the coolant water flow as a function of such steel residence time in each zone, giving the total effective quantity of cooling water that an element of steel should receive in each zone, determining the zone flow rates as a function of average speed, grade and section size of the strand, measuring the total quantity of specific cooling water that each element of steel has actually received from the sprays, comparing the computed amount of cooling water that an element of steel should receive in each zone with the measured specific amount of cooling water actually received by such element of steel in that zone to provide a coolant flow correction based on said comparison, incorporating said flow correction as a feedback signal for maintaining a calculated setpoint for correcting the amount of coolant flow through said nozzles in each zone to effectively cool said steel, whereby the feedback control supplements the residence time computed flow.

9. A method of controlling secondary cooling of a continuous metal casting having a cooling area that is divided into a number of zones in which a plurality of spray water nozzles are located, comprising:

determining for each element of steel the steel residence time in each spray zone and controlling the coolant water flow as a function of steel residence time in each zone;

measuring the amount of cooling water received by the steel strand in each spray zone of said spray area and determining a measured value of cooling for each element of strand in each spray zone; and further adjusting said coolant water flow based on said measured value of cooling by monitoring the amount of cooling that the strand has received in each spray zone and using said measured value of actual cooling to determine the amount of adjusted coolant water to trigger a feedback error correction signal to supplement said residence time computed flow.

10. System for controlling heat removal from a continuous metal caster having water nozzle cooling means for solidifying strand casting and means for controllably withdrawing the strand as cast, said water nozzle cooling means being located in a cooling area which is divided into a plurality of cooling zones, comprising:

water history generator means for determining for each strand element the amount of coolant water required in each zone; average water history calculator means for computing the amount of cooling water required for each cooling zone and the average amount of actual cooling received for each strand element in each zone, said average water history calculator means usng average speed and residence time for calculating said amount required and said amount received;

residence time means for determining the average residence time of each strand element in each spray cooling zone;

speed means for determining the average speed of each strand element through each spray zone;

zone flow setpoint generator means responsive to said average water history calculator means for determining feedforward setpoint values representing the amount of cooling water required for each zone;

means for determining the total measured quantity of cooling water that each strand element has received;

feedback flow correction means for comparing the zone flow setpoint values with said values of measured quantity of cooling water received by each strand element and providing a feedback flow correction signal for correcting said setpoint values to a corrected setpoint signal; and flow input control means responsive to said corrected setpoint signal for controlling said water nozzle cooling means associated with each spray zone to produce a corrected coolant flow in each spray zone.

11. System for controlling heat removal from a continuous steel caster having a secondary cooling chamber including water spray nozzles located in a cooling area divided into a plurality of cooling zones, comprising:

means for determining setpoint values representing the amount of cooling water an element of steel strand should receive for a predetermined reference time for said element in each zone in said secondary cooling chamber;

means for cooling each element of steel strand as a function of residence time in respective zones of said secondary cooling chamber;

means for measuring the actual quantities of coolant water sprayed onto each element of steel strand; and feedback control means responsive to said setpoint values and said measured actual quantities of coolant water for applying a feedback water flow correction signal to produce a modified residence time flow signal.

* * * * *